US006311588B1

(12) United States Patent
St. John et al.

(10) Patent No.: US 6,311,588 B1
(45) Date of Patent: Nov. 6, 2001

(54) SELF ADJUSTING UTILITY PLIERS

(75) Inventors: Robert A. St. John, Cheshire; Keith Lombardi, Farmington, both of CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/482,562

(22) Filed: Jan. 14, 2000

(51) Int. Cl.[7] ..... B25B 7/04

(52) U.S. Cl. ..... 81/409; 81/407; 81/408; 81/411; 81/392

(58) Field of Search ..... 81/409, 407, 408, 81/411, 413, 391, 392

(56) References Cited

U.S. PATENT DOCUMENTS 4,651,598 * 3/1987 Warheit .
5,660,089 * 8/1997 Chow .
6,000,303 * 12/1999 Chang .
6,101,908 * 8/2000 Azkona .

* cited by examiner

*Primary Examiner*—Timothy V. Eley
*Assistant Examiner*—Willie Berry, Jr.
(74) *Attorney, Agent, or Firm*—Pillsbury Winthrop LLP

(57) ABSTRACT

Self-adjusting pliers including first and second members each handle portions and jaw portions. The first member defines a rack having a plurality of teeth. A rack engagement structure is mounted to an intermediate portion of the second member and positioned adjacent the rack. During initial manual movement of the handle portions towards one another, the rack engagement structure travels in disengaged, spaced relation with respect to the rack. Then, after the jaw portions engage opposing sides of a workpiece, continued movement of the handle portions towards one another causes movement of the rack engagement structure toward the rack until the rack engagement structure engages the rack. The rack engagement structure has a movement restrictive portion being cooperable with the rack so as to limit the movement of the rack engagement structure toward the rack when the jaw portions contact one another in the absence of a workpiece therebetween.

7 Claims, 11 Drawing Sheets

SELF ADJUSTING UTILITY PLIERS

FIELD OF THE INVENTION

The present invention relates generally to utility pliers and, more particularly to self-adjusting pliers that can be locked in a storage position and released to an operating position capable of grasping a workpiece.

BACKGROUND OF THE INVENTION

Many types of handheld utility pliers are known in the art. Conventional pliers typically include two rigid plier members interconnected in a scissors-like arrangement allowing for a workpiece to be grasped by jaw portions of the pliers in response to movement of handle portions of the pliers. Over the years, numerous improvements have been made to the conventional plier design in order to obtain a better and more efficient plier. For example, self-adjusting pliers have been developed in order to provide a set of pliers that more easily adjust to the size of a given workpiece.

A basic feature of self-adjusting pliers, such as those disclosed in application Ser. No. 09/108,561, hereby incorporated by reference, is that they provide two rigid structures having respective handle portions and jaw portions, a rack engagement structure mounted on one of the rigid structures, and a rack provided on the other rigid structure.

In these types of pliers, however, when there is an absence of a workpiece between the jaw portions and manual force is applied to the handle portions toward one another, the jaw portions eventually engage one another and then frictionally rub against one another as the rack engagement structure moves toward the rack and until the rack engagement structure engages the rack. Because users may have a tendency to work the tool without a workpiece between the jaw portions (e.g., to test the tools prior to a clamping operation), the point of engagement between the jaw portions tends to be a primary area of wear. In addition, the relative movement between the contacting jaw portions may cause some misalignment between the jaw tips during some points of operating the tool, which may be undesirable from a cosmetic point of view.

In addition, the self-adjusting pliers in the aforementioned incorporated Application have handle members that are spring biased apart. Thus, when the tool is not being used, the handle members are spread wide apart. As a result, such pliers occupy a relatively large amount of space when being stored. Thus, there exists a need to provide self-adjusting pliers that can be efficiently secured in a compact configuration for storage purposes.

SUMMARY OF THE INVENTION

It is the object of the present invention to fulfill the needs expressed above. In accordance with the principles of the present invention, this objective is accomplished by providing self-adjusting pliers comprising a first member providing a first handle portion and a first jaw portion and a second member providing a second handle portion and a second jaw portion. The first member defines a rack having a plurality of teeth, while a rack engagement structure is mounted to an intermediate portion of the second member and positioned adjacent to the rack. A spring structure is constructed and arranged to bias the first handle portion apart from the second handle portion into a fully opened position. The rack engagement structure is positioned relative to the rack such that during the initial manual movement of the first and second handle portions toward one another, the rigid structures pivot relative to one another. The rack engagement structure travels in disengaged, parallel facing relation with respect to the rack. The first member is connected to the second member such that, after the first and second jaw portions engage the opposing sides of the workpiece, continued manual movement of the first handle portion towards the second handle portion against the bias of the spring structure, will cause the rack engagement structure to move toward the rack until the rack engagement structure engages the rack. Continued application of manual force to the first handle portion towards the second handle portion causes the application of such force to the workpiece through the rack engagement structure. The rack engagement structure has a movement restrictive portion that is cooperable with the rack so as to limit the movement of the rack engagement structure toward the rack when the jaw portions contact one another in the absence of a workpiece therebetween, which reduces friction between the jaw portions when the jaw portions contact one another in the absence of a workpiece therebetween.

An objective of the present invention is also achieved by providing a selfadjusting pliers comprising a first member that provides a first jaw that has a first workpiece engaging surface and a first handle member and a second member that provides a second jaw opposing the first jaw and a second handle member opposing the first handle member. The second jaw has a second workpiece engaging surface that faces generally towards the first workpiece engaging surface. A spring structure biases the handle members apart from one another. The first and second jaws are operatively connected to the handle members such that manually moving the handle members towards one another against the bias of the spring structure moves the jaws towards one another in a closing direction to move the workpiece engaging surfaces towards one another for grasping a workpiece. The spring structure is constructed and arranged to move the jaws apart from one another in an opening direction towards and into a fully opened position when the handle members are manually released. The first member provides an engageable rack and the second member provides a rack engagement structure. The rack engagement structure and the engageable rack are constructed and arranged such that, when the rack engagement structure is engaged with the rack, movement of the handle members towards one another as aforesaid causes the handle members to pivot relative to one another about the rack engagement structure so as to continue moving the jaws toward another. The rack engagement structure and the engageable rack are positioned with respect to one another such that, as the jaws are being moved in the closing direction thereof to grasp a workpiece, the second member moves relative to the first member so as to engage the rack engagement structure with the engageable rack in response to the workpiece engaging surfaces of the jaws contacting opposing sides of the workpiece. A releasable lock is carried by one of the first and second members. The lock is manually movable between (a) a releasably locked position and a released position wherein, when the handle members have been moved toward one another into a fully closed position, the lock engages a structure on the other of the first and second members to prevent relative movement between handle members under bias of the spring structure and hence relative movement between the jaw portions, and (b) a released position wherein the lock is disengaged from the aforesaid structure to permit both relative movement between the handle portions and relative movement between the jaws.

DETAILED DESCRIPTION OF THE PREFERRED EMBODIMENTS OF THE INVENTION

Figure 1:
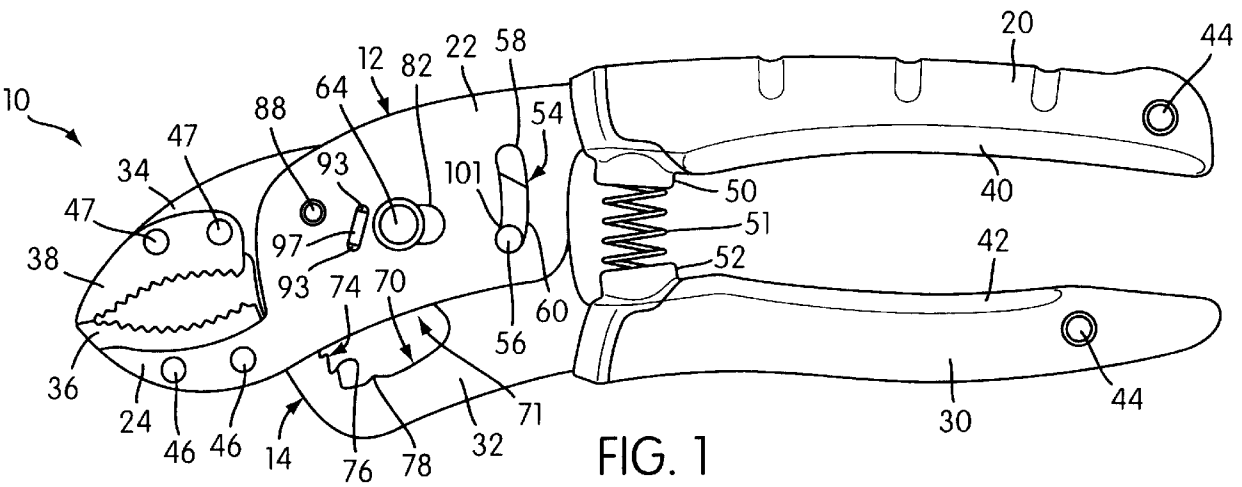
FIG. 1 is a left side elevational view of a preferred embodiment of the hand held self-adjusting pliers embodying the principles of the present invention, shown in a fully closed position

Referring now, more particularly to the drawings, there is shown in FIG. 1 thereof a preferred embodiment of the self-adjusting pliers 10 of the present invention in a fully closed, but unlocked position. The pliers, generally indicated at 10, include a first rigid member, generally indicated at 12 and a second rigid member generally indicated at 14, which are interconnected in a generally scissors-like orientation in order to effortlessly and efficiently adjust to the size of any given workpiece.

Figure 2:
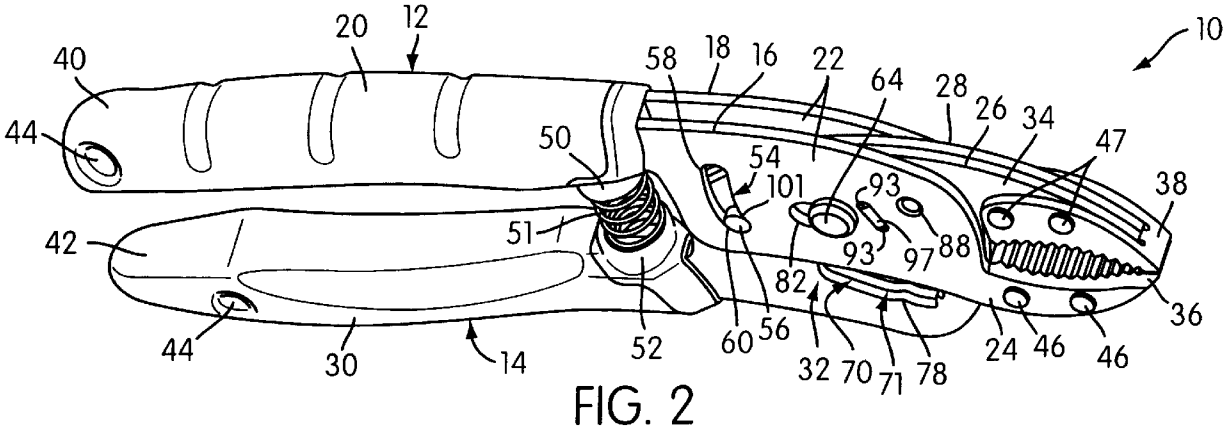
FIG. 2 is a perspective view, looking down at the front and right sides, of the preferred embodiment of the hand held self-adjusting pliers embodying the principles of the present invention, shown in a fully closed position.
Figure 3:
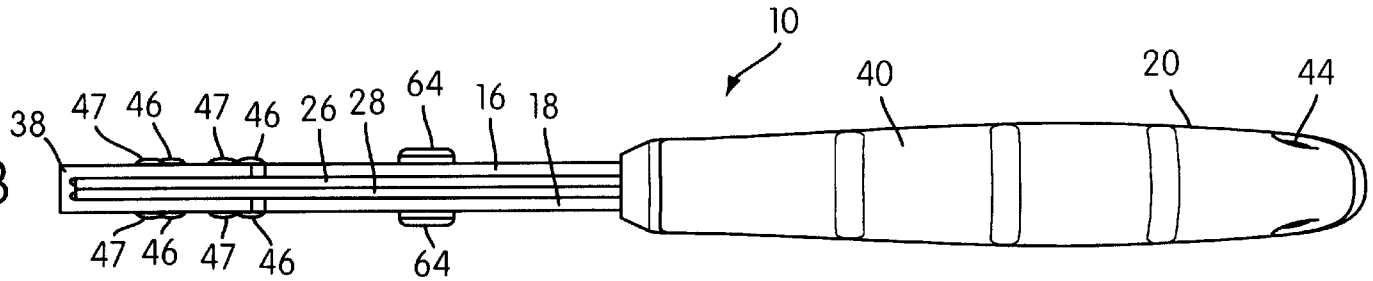
FIG. 3 is a top plan view thereof.
Figure 4:
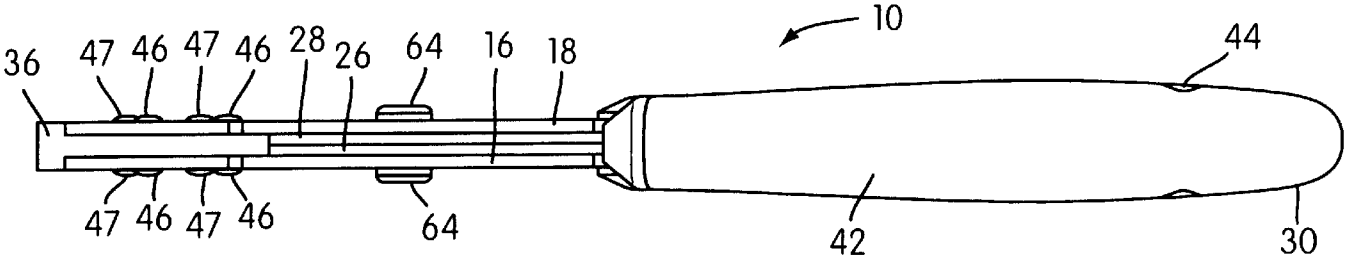
FIG. 4 is a bottom plan view thereof.
Figure 6:
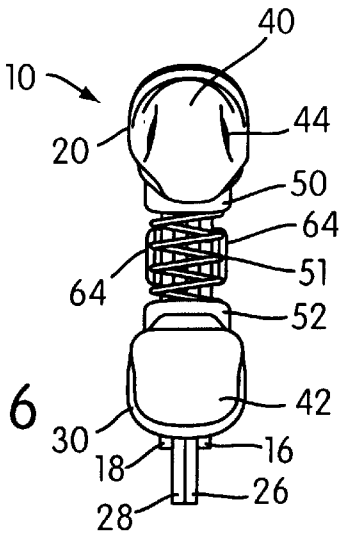
FIG. 6 is a rear elevational plan view thereof.
Figure 5:
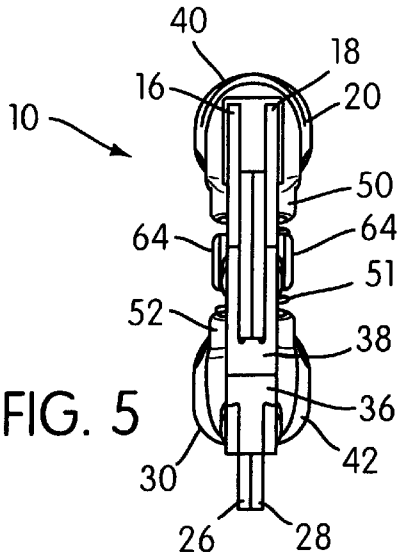
FIG. 5 is a front elevational plan view thereof.

Referring specifically to FIGS. 2–6, the first rigid member 12 and the second rigid member 14 are preferably formed of a laminated steel construction. As shown in FIGS. 2–6, the first member 12 includes relatively spaced apart first and second outer steel laminations 16 and 18, which form a first handle portion 20, which is shown in conjunction with a surrounding resilient grip 40, a first intermediate portion 22 and a first jaw portion 24. The second member 14 includes adjacent first and second steel laminations 26 and 28 that make up a second handle portion 30, which is shown in conjunction with a surrounding resilient grip 42, a second intermediate portion 32 and a second jaw portion 34. As best shown in FIG. 2, the adjacent laminations 26 and 28 of the intermediate portion 32 of the second member 14 are received between the spaced apart lamination 16 and 18 of the intermediate portion 22 of the first member 12. Workpiece engaging jaws 36 and 38 are mounted on the jaw portions 24 and 34, respectively, as will be more fully appreciated from FIG. 8 and the accompanying description herein. Preferably, the handle portions 20 and 30 provide a hole 44 for hanging the self-adjusting pliers when not in use.

Figure 8:
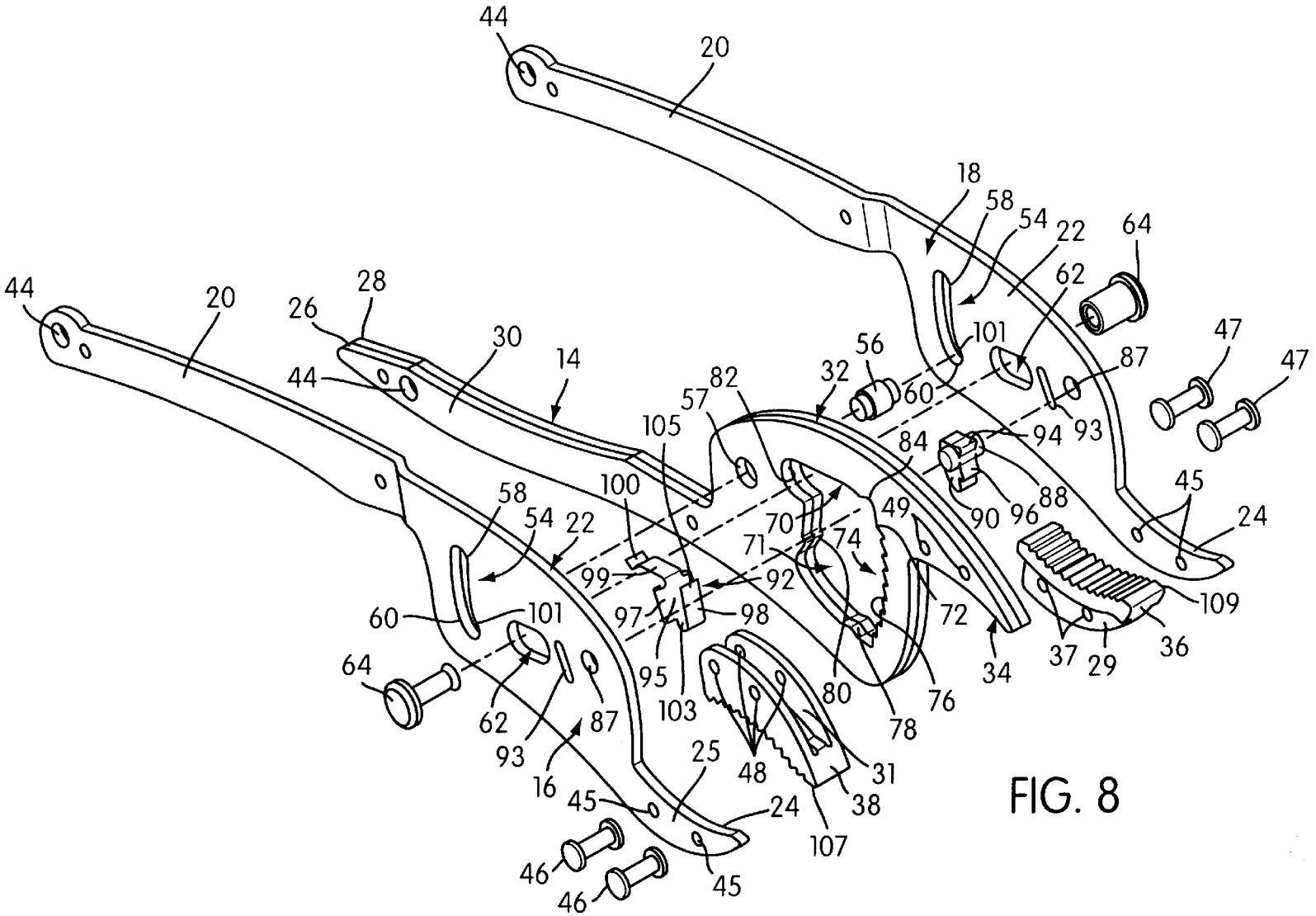
FIG. 8 is an exploded view of the self-adjusting pliers shown in FIG. 1.

As illustrated in the exploded view of FIG. 8, the jaw portion 24 of the pliers is formed by the front ends 25 and 27 of the laminates 16 and 18, respectively. A pair of rivets 46 secures a workpiece engaging jaw 36 between the front ends 25 and 27. Each rivet 46 extends through aligned holes in the front ends 25 and 27 and the jaw 36. As shown, a hole indicated at 45 is provided through the laminate 16, a hole indicated at 37 is provided through a narrowed thickness portion 29 of the workpiece engaging jaw 36 and a hole indicated at 45 in the laminate 18. The rivets 46 are passed through these holes before being swaged at opposite ends thereof as shown. As also shown in FIG. 8, the workpiece engaging jaw 38 is provided with a recess 31 that enables it to receive the jaw portion 34 of the adjacent laminates 26 and 28 and is secured to the jaw portion 34 by a pair of rivets 47. The rivets 47 extend through hole 48 in the workpiece engaging jaw 38 and hole 49 on the laminates 26 and 28, before being swaged.

The lamination members 16 and 18, 26, and 28 are preferably die-stamped or laser-cut from high grade, heat-treated sheet steel. The workpiece engaging jaws 36 and 38 on the respective jaw portions 24 and 34 can be formed by investment cast steel die-stamped or laser-cut steel, forged or die cast metallic materials, tool steel, or injection molded resinous plastic materials, or other conventional materials previously used or usable on pliers 10.

Figure 7:
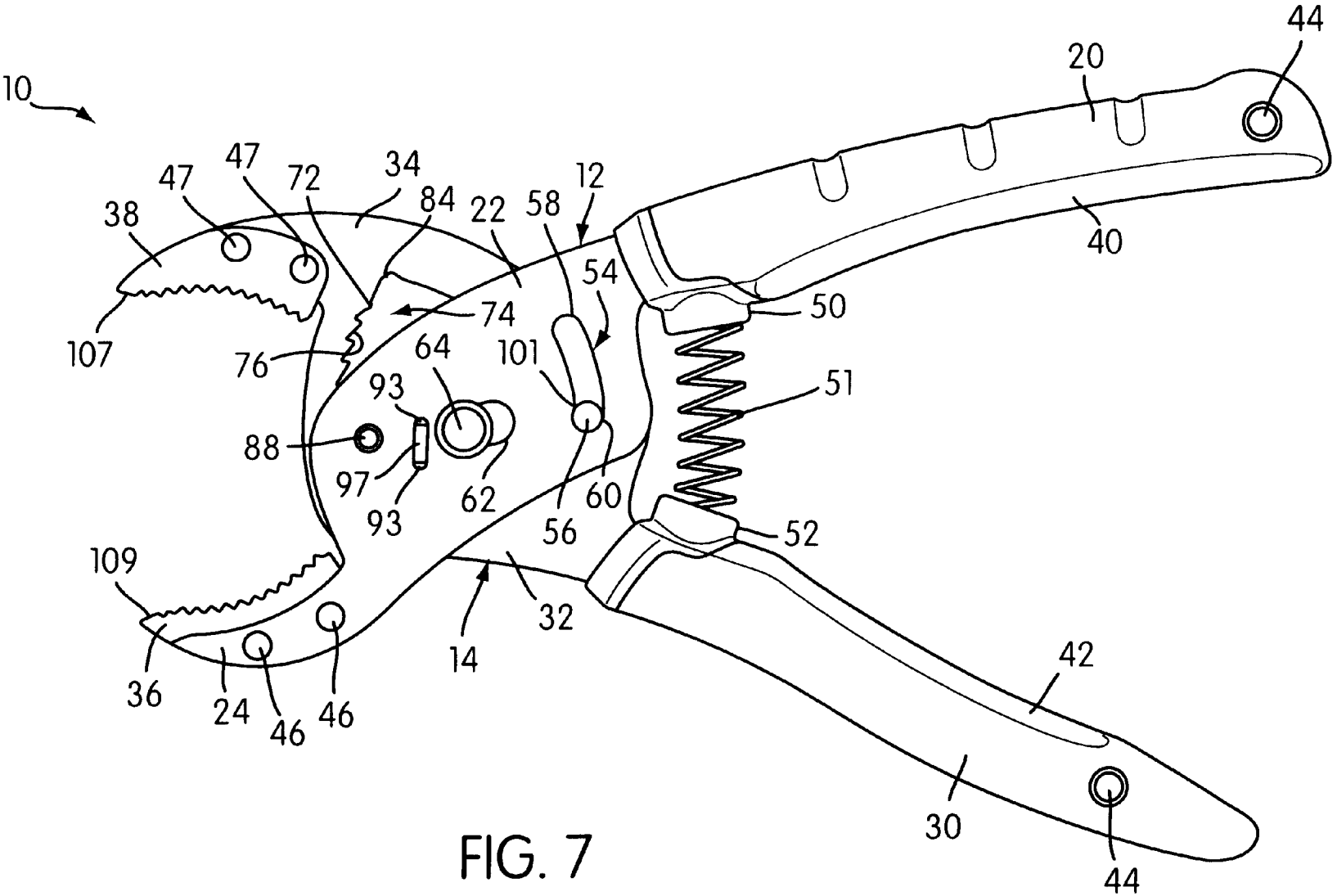
FIG. 7 is a side elevational view of the preferred embodiment of the hand held self-adjusting pliers embodying the principles of the present invention in a fully opened position.

As shown in FIG. 7, the self-adjusting pliers 10 include a spring structure in the form of a coil spring 51 for biasing the handle portions 20 and 30 and the jaw portions 24 and 34 away from one another such that the self-adjusting pliers 10 are moved into a fully open position. Preferably, the opposing ends of the spring structure 51 are received in cavities 50 and 52 formed in molded plastic portions of the resilient grips 40 and 42 and bias the handle portions 20 and 30 away from one another.

Figure 9A:
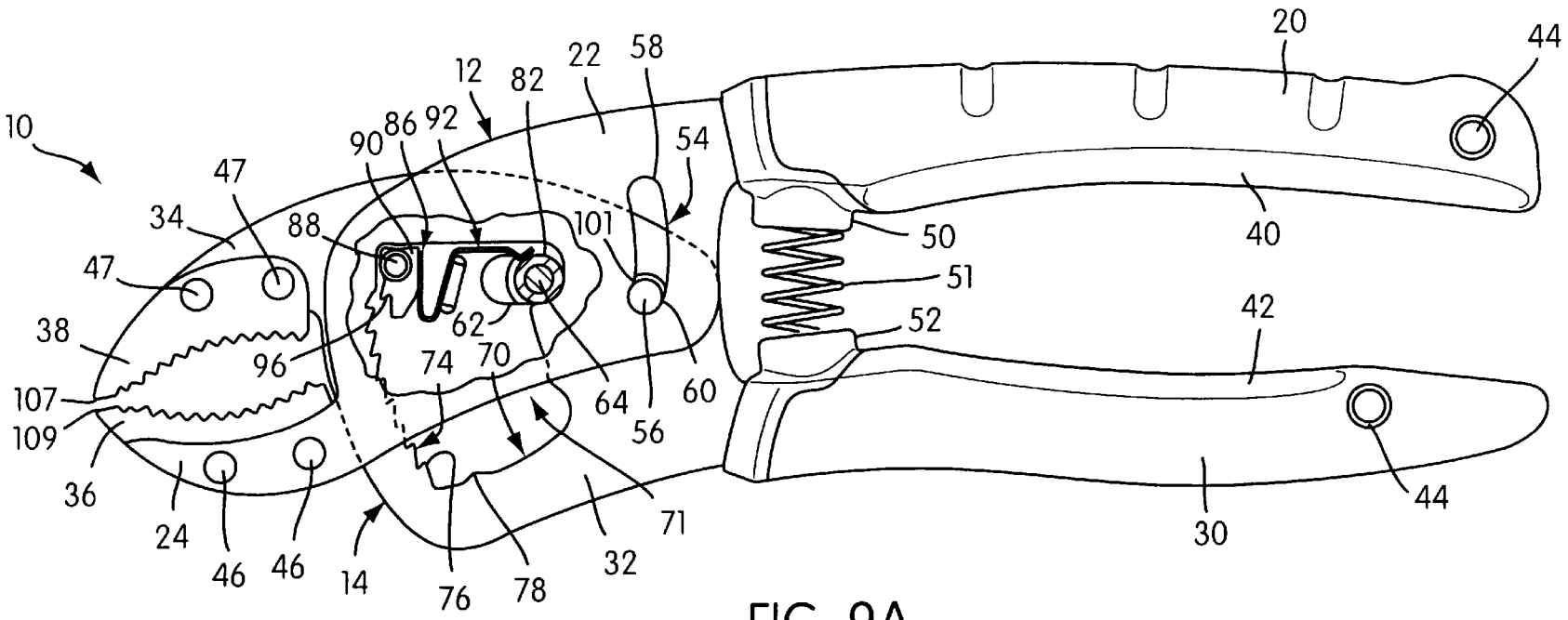
FIG. 9A is a side elevational view of the self-adjusting pliers with certain portions removed to better illustrate others and showing the first and second members in a locked storage position.
Figure 9B:
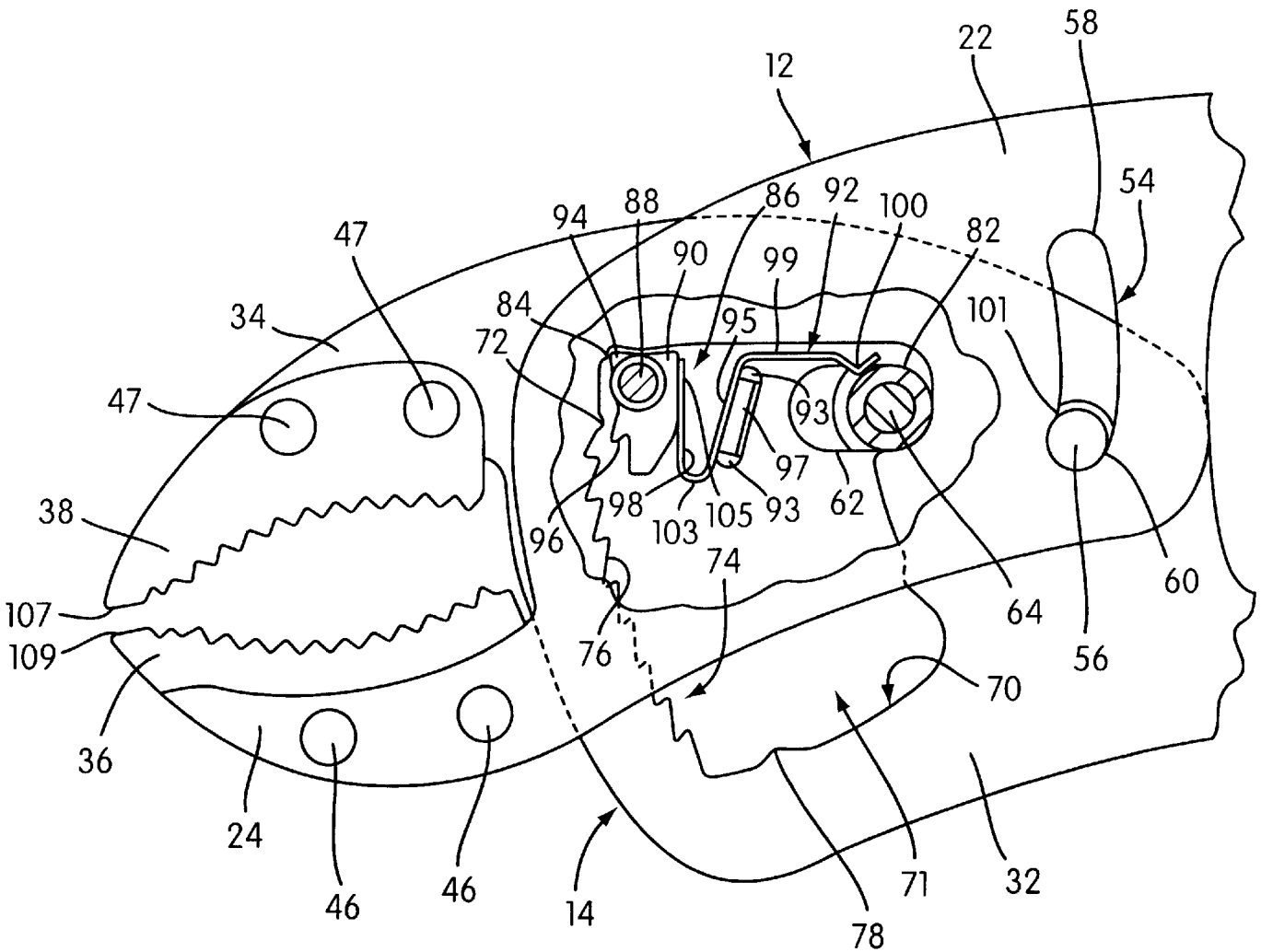
FIG. 9B is a partial enlarged side view of FIG. 9A.

With particular reference to FIG. 8, the spaced laminations 16 and 18 cooperate to define a positioning slot 54 formed in the intermediate portion 22 of the first member 12. As best shown in FIGS. 9A and 9B, the positioning slot 54 includes a generally arcuate portion 58 and a doglegged end portion 60. At the transition between the arcuate portion 58 and the doglegged end portion 60 is a camming surface 101 in communication with the generally arcuate portion 58. As best shown in FIG. 8, the laminations 26 and 28 of the second member 14 have an opening 57 at the intermediate portion 32 that carries a pivot pin 56. Referring back to FIGS. 9A and 9B, the pivot pin 56 is shown disposed in the positioning slot 54 within doglegged end portion 60 to form a first pivot.

Referring back to FIGS. 1, 2 and 8 there is shown a slot 62 formed in both the spaced apart first and second laminations 16 and 18. The slot 62 is positioned and arranged to hold a releasable locking structure 64 in slidable condition between a rearward locking position wherein it is received in a locking recess 82 formed in the second member 14 and a forward releasing position wherein it is removed from the locking recess 82.

It will be further appreciated that the adjacent laminates 26 and 28 provide a peripheral edge 70 defining a large opening 71 in the member 14 as best shown in FIG. 8. The edge 70 defines the aforementioned locking recess 82 on a rearward surface thereof, and a rack 74 having a plurality of teeth 76 on a forward surface thereof.

A rack engagement structure 86 is mounted between the spaced apart laminates 16 and 18 to the intermediate portion 22 of the first member 12, as best shown in FIGS. 9A and 9B. Preferably the rack engagement structure 86 includes a rack engaging member 90 pivotally mounted to the first member 12 by a pivot pin 88 carried between two openings 87 in the laminates 16 and 18. The rack engagement structure 86 further includes a rack engaging member positioning spring, preferably in the form of a generally U shaped spring member, 92 engaged with the rack engaging member 90 to maintain it in a desired pivotal position.

The spring member 92 has an intermediate portion 95 disposed between opposing mounting portions 97 fixed between mounting openings 93 in the spaced apart laminates 16 and 18, as best shown in FIGS. 8, 9A and 9B. Extending from the intermediate portion 95, the spring member 92 comprises a rack engaging member engaging portion 98, which includes a generally U shaped portion 103, and a leg portion 105 disposed in engagement with the rack engaging member 90. This engaging portion 98 is normally relaxed (i.e., when the rack engaging member 90 is spaced from the rack 74) and in this condition maintains the rack engaging member 90 in a pivotal position such that the engagement teeth 96 face the rack teeth 76 in generally parallel facing relation that facilitates engagement of teeth 96 with teeth 76 when the teeth 76, 96 are brought together. The spring member 92 further includes a rearwardly extending portion 99 that terminates in a generally V shaped portion 100. The V shaped portion 100 is positioned to releasably hold the releasable locking structure 64 into the locking recess 82 when in the locked position or out of the recess 82 when locking structure 64 is manually moved out of recess 82 into the releasing position.

The peripheral edge 70 further defines a rack engaging member stop 78 which engages rack engaging member 90 and a lock stop 80 which engages locking structure 64 to stop the opening movement of the pliers 10 when the pliers 10 are biased into the fully opened position. The peripheral edge 70 further includes a rack engaging member receiving notch 84 for receiving a movement restrictive portion 94 of the rack engaging member 90 when the pliers 10 are in a fully closed position. Finally the peripheral edge 70 includes a rack engaging member engaging ridge 72 for providing a pivotal stop for the rack engaging member 90 when the pliers 10 are manually forced into the fully closed position when no workpiece is disposed between the jaws.

The rack engaging member 90 is positioned relative to the rack 74 such that during the initial manual movement of the first handle portion 20 towards the second handle portion 30, the rack engaging member 90 travels in disengaged, parallel facing relation with respect to the rack teeth 76. The rack engaging member 90 further comprises a plurality of engagement teeth 96 constructed and arranged to face the teeth 76 on the rack 74 and normally held in such position by the spring member 92.

Operation

Referring to FIGS. 9A–13, the operation of the self-adjusting pliers 10 and the self-adjustment thereof to grasp a workpiece will be described. More specifically, FIGS. 9A and 9B show the first and second members when the self-adjusting pliers 10 are in a locked storage position. The first and second rigid members 12 and 14 are fixed relative to one another, as handle portions 20 and 30 cannot move when force is applied to them towards or away from one another. The V shaped protrusion 100 of the spring 92 releasably holds the releasable locking structure 64 into the locking recess 82. In this locked position, the rack engaging member 90 is in disengaged parallel facing relation with respect to the rack 74 and spaced from the peripheral edge 70. The jaw portions 24 and 34 are slightly spaced from one another. The rearward pivot pin 56 is positioned in the end portion 60 of the positioning slot 54.

The self-adjusting pliers are unlocked by manually sliding the releasable lock 64 forwardly out of the locking recess 82 and into an operating released position, riding past the V shaped portion 100 by flexing of the resilient spring member 92. Once the handle portions 20 and 30 are no longer locked by the releasable locking structure 64, the spring structure 51 can bias the handle portions 20,30 apart until the handle portions 20, 30 and the jaws 36, 38 are in the fully opened position, as best shown in FIG. 10.

Figure 10:
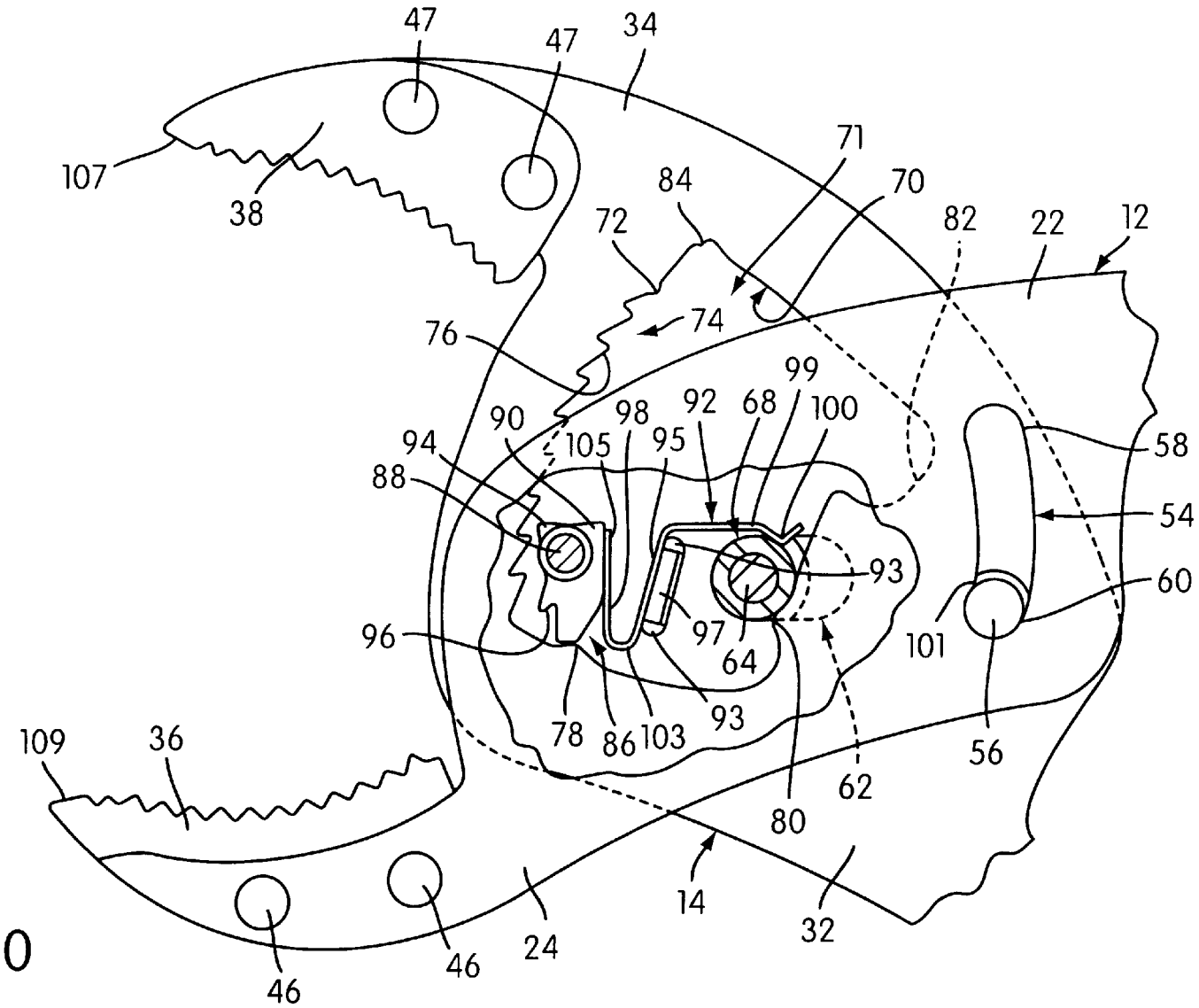
FIG. 10 is a side elevational view of a preferred embodiment of the hand held self-adjusting pliers, with certain portions removed to better illustrate others, and showing the pliers in a fully opened position.

As shown in FIG. 10, when the members 12 and 14 are biased into the fully opened position, the rearward pin 56 is retained in the end portion 60 of the positioning slot 54 and the pin 56 acts as a pivot point for the members 12 and 14 during this movement.

When biased into the fully opened position as shown in FIG. 10, the opening movement of the jaw portions 24 and 34 away from each other is limited by the lock stop 80 on the peripheral edge 70 engaging the locking structure 64. In addition, the rack engaging member stop 78 on the peripheral edge 70 engages the rack engaging member 90 and arrests further movement of the rack engaging member 90 if additional force is applied to overcome stop 80.

The V shaped portion 100 of the spring member 92 insures that the releasable locking structure 64 will not interfere with the opening or closing functions of the self-adjusting pliers 10 by releasably holding the releasable lock 64 in its unlocked position out of recess 82 during the operation of the self-adjusting pliers 10.

Figure 11:
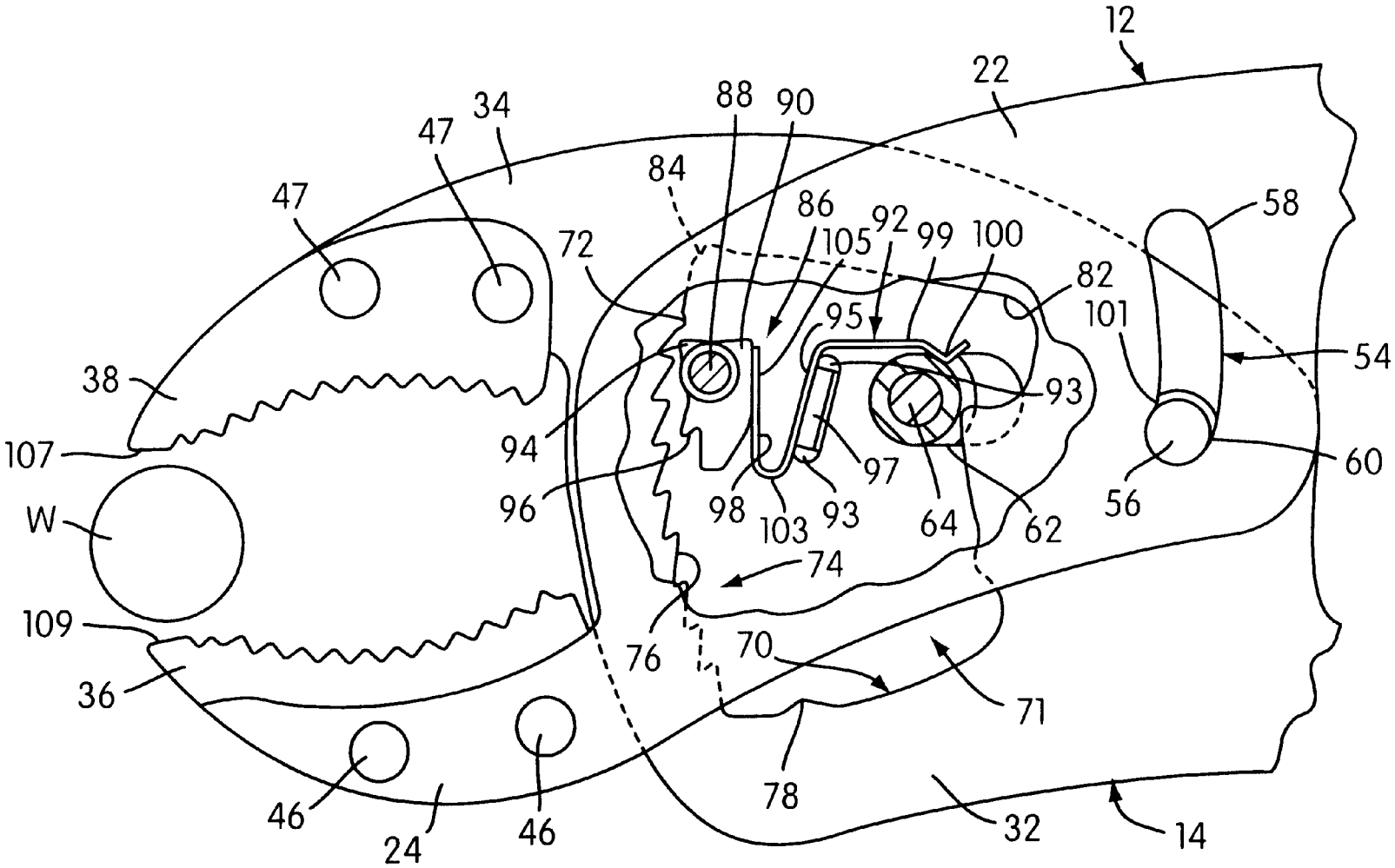
FIG. 11 is a side elevational view similar to FIG. 10, but showing the pliers after the handle members are moved toward one another and prior to engaging a workpiece.

Referring to FIG. 11, the rigid structures 12 and 14 are shown being moved in a pivotal action about pivot pin 56 in response to an initial manual force placed upon the handle portions 20, 30 in a closing direction. The rigid structures 12 and 14 are connected to one another such that, the first and second jaw portions 24 and 34 and hence jaws 36, 38 move toward one another against the bias of the spring structure 51. During this pivotal movement, the teeth 96 of the rack engaging member 90 move in disengaged parallel facing relation with respect to the teeth 76 of rack 74.

Figure 12:
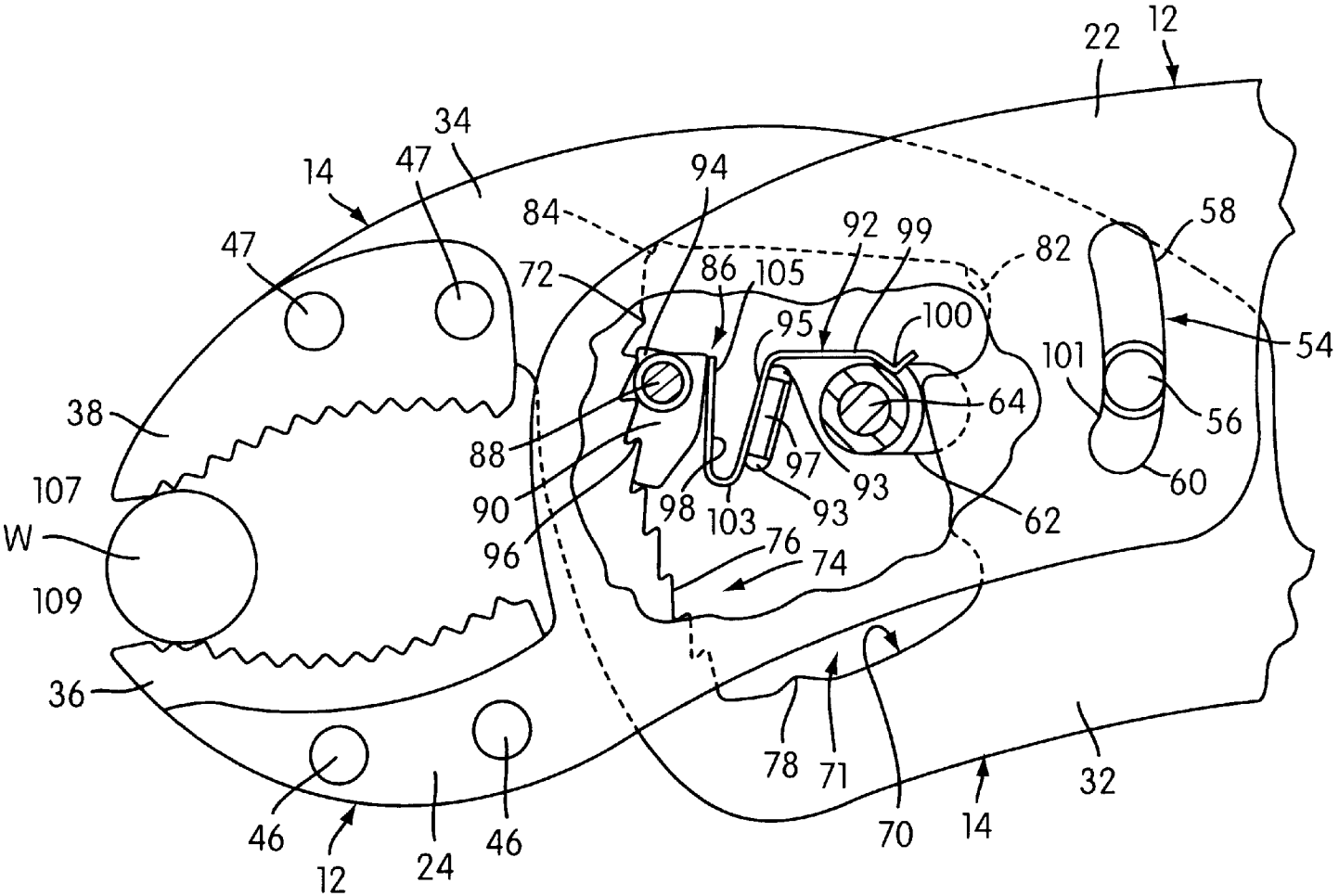
FIG. 12 is a partial enlarged side view similar to FIG. 11, but showing the pliers engaged with a workpiece.

As best shown in FIG. 12, the continued movement of the jaws 36, 38 toward one another eventually causes the jaws to engage a workpiece W therebetween. The points of engagement between the workpiece engaging jaws 36 and 38 and workpiece W become temporary pivot points for the first and second members 12 and 14. The first and second members 12 and 14 begin to pivot about the temporary pivot points against the bias of the spring structure 51. As the handle members 20 and 30 move toward one another, the pivot pin 56 begins to move along slot 54 and cams against the camming surface portion 101 and then rides into the generally arcuate portion 58 of the positioning slot 54. The camming action of pin 56 against the camming surface 101 forces the first member 12 to shift forwardly relative to the second member 14, which causes the rack engaging member 90 and pivot pin 88 on the second member 14 to shift towards the rack 74.

Because the teeth 96 of the rack engaging member 90 are retained in parallel facing relation to teeth 76 of rack 74 by the leg portion 105, the teeth 96 and 76 easily mesh into one another. As the engagement teeth 96 of rack engaging member 90 contacts the rack teeth 76, the pivot point of the handle members 20 and 30 shifts from the temporary pivot point to a forward pivot point, provided by the rack engagement structure 86, and particularly the forward pivot pin 88. After the pivot point shifts from the rearward pin 56 to the forward pivot pin 88, continued movement of the handle portions 20 and 30 toward each other will result in a clamping force being applied to the workpiece through the pivot point 88.

When the workpiece is removed from between the jaws 36 and 38, it is advantageous for self-adjusting pliers 10 to lock in a closed, storage position. As manual force is applied to the handle portions 20 and 30, the jaw portions 24 and 34 are brought closer to one another. The releasable locking structure 64 becomes fully aligned with the locking recess 82 defined by the peripheral edge 70. The releasable locking structure 64 can then be slid into the locking recess 82, passing the generally bent V shaped protrusion 100 of the spring member 92. Once the V shaped portion is passed, the releasable lock can be slid into the locking recess 82, thus locking the selfadjusting pliers 10 into a closed, storage position.

Figure 13:
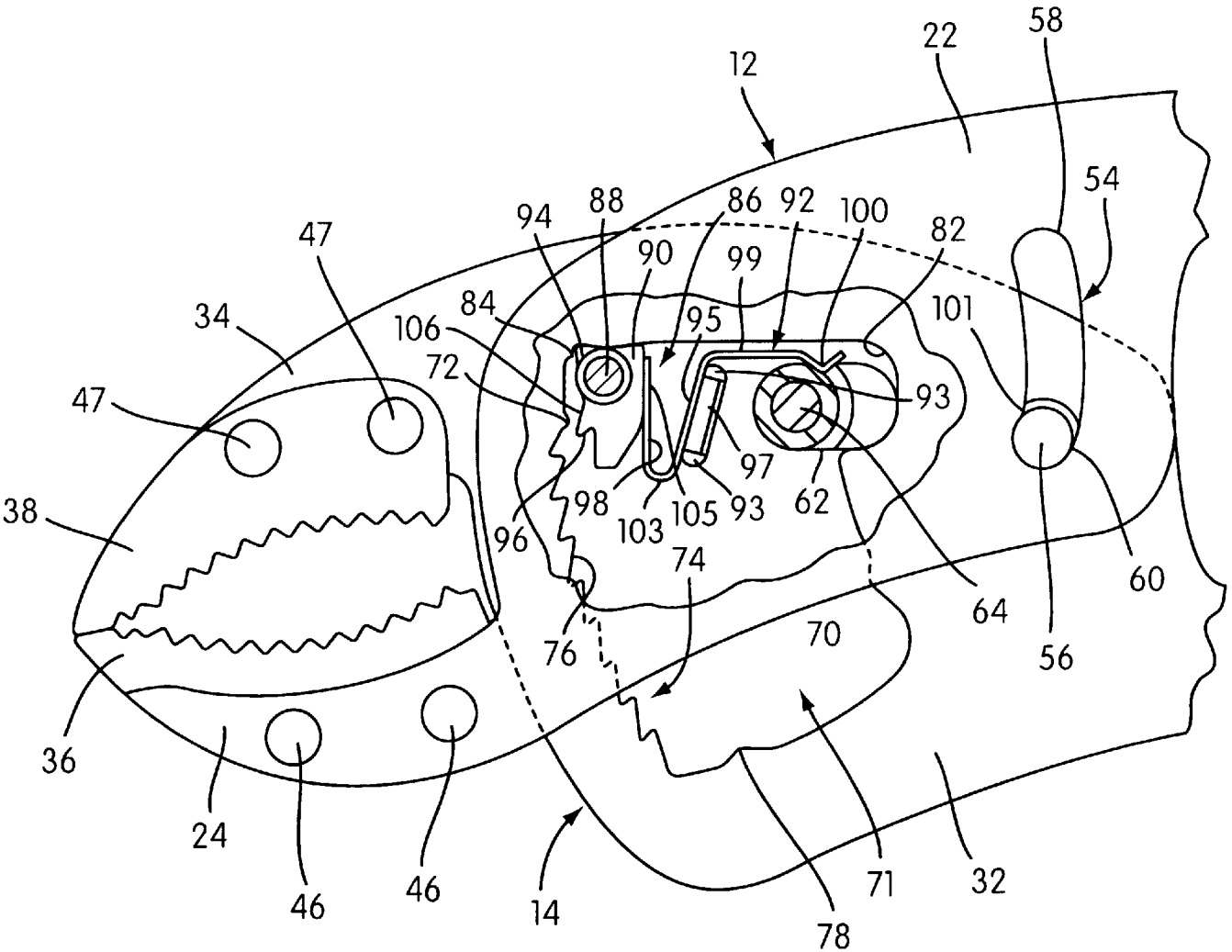
FIG. 13 is a partial enlarged side view similar to FIG. 12, but showing the pliers in an initial fully closed, unlocked position in the absence of a workpiece between the plier jaws.
Figure 14:
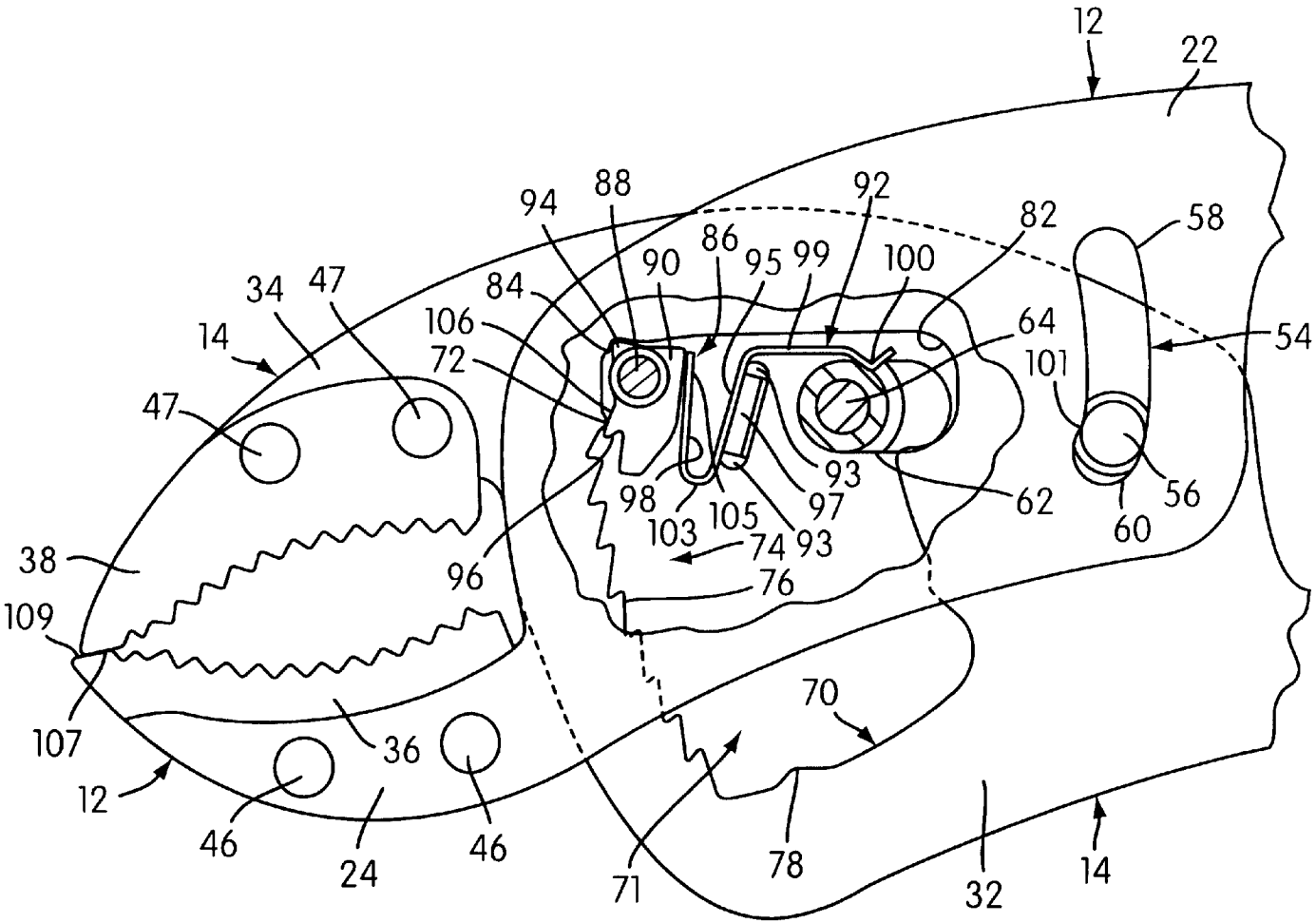
FIG. 14 is a partial enlarged side view of the self-adjusting pliers similar to FIG. 13, but showing the rack engagement structure locked out of engagement with the rack when a further manual force is applied to close the handle members beyond the position shown in FIG. 13.

It should be understood that the operation of the self-adjusting pliers without a workpiece is identical for that with a workpiece, with the exception of the operation of the forward pivot, which will be now described. As noted above, the preferred embodiment of the self-adjusting pliers 10 includes a rack engaging member receiving notch 84 and a rack engaging member engaging ridge 72 on the peripheral edge 70. When the handle portions 20 and 30 are moved to a fully closed position so that the workpiece engaging jaws 36 and 38 contact one another, as shown in FIG. 13, the point of contact between the jaw members act as the temporary pivot point. At this relative orientation, the pivotal movement restrictive portion 94 of the rack engaging member 90 is received within the rack engaging member receiving notch 84. As best shown in FIG. 14, further forcing of the handle members towards one another causes the camming surfaced to engage the pin 56 and cause slight forward shifting of pivot pin 88, and thus causing only very slight pivotal movement of the rack engaging member 90 about this portion 94 until the top surface 106 of the rack engaging member 90 engages the rack engaging member engaging ridge 72 to arrest further pivotal movement of the rack engaging member 90. This locks the teeth 96 out of engagement with the rack teeth 76. To this end, there is no significant forward shifting movement of the rigid members 12 and 14 under the influence of camming surface 101 and only slight relative movement of the jaw end surfaces 107 and 109 against one another to minimize frictional wear therebetween. In other words, because the teeth 76 of the rack 74 and the teeth 96 of the rack engaging member 90 are locked out of fully meshing relationship in FIG. 14, the forward shifting of the member 12 that would otherwise take place to enable such meshing is avoided. Because this relative shifting between members 12 and 14 is avoided when the jaws 36 and 38 are engaged with one another, frictional wear between the jaws 36 and 38 is reduced at the fully closed position. In addition, because no further forward movement of the first rigid member 12 occurs beyond the position illustrated in FIG. 14, misalignment of the tips 107, 109 is reduced when there is an absence of a workpiece W therebetween.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. Self-adjusting pliers for grasping a workpiece, said pliers comprising:

a first member providing a first handle portion and a first jaw portion;

a second member providing a second handle portion and a second jaw portion;

said first member defining a rack having a plurality of teeth;

a rack engagement structure mounted to an intermediate portion of said second member and positioned adjacent said rack;

a spring structure constructed and arranged to bias said first and second handle portions apart from one another so as to bias said first and second jaw portions apart from one another to a fully opened position, said rack engagement structure being positioned relative to said rack such that during said initial manual movement of said first and second handle portions towards one another, said rack engagement structure travels in disengaged, spaced relation with respect to said rack, said first and second members being connected to one another such that, after said first and second jaw portions engage the opposing sides of the workpiece, continued manual movement of said first and second handle portions towards one another against the bias of said spring structure causes movement of said rack engagement structure toward said rack until said rack engagement structure engages said rack, so that continued application of manual force to said first and second handle portions toward one another after engagement of said rack engagement structure with said rack causes application of such force to said workpiece through said rack engagement structure, said rack engagement structure having a movement restrictive portion being cooperable with said rack so as to limit said movement of said rack engagement structure toward said rack when said jaw portions contact one another in the absence of a workpiece therebetween, so as to reduce friction between said jaw portions when said jaw portions contact one another in the absence of a workpiece therebetween.

2. Self-adjusting pliers according to claim 1, wherein said rack engagement structure is received in an opening defined in said first member by a peripheral edge, said rack forming a portion of said peripheral edge, wherein said rack engagement structure is spaced from said peripheral edge of said opening during said initial manual movement of said first and second handle portions toward one another, said rack engagement structure having engagement teeth that engage the teeth on said rack, and further comprising a normally relaxed spring connected with said rack engagement structure, said relaxed spring positioning said rack engagement structure so that the engagement teeth thereof face said teeth of said rack when said rack engagement structure is disposed in said disengaged, spaced relation with respect to said rack, thus facilitating engagement of said rack engagement structure with said engagement teeth of said rack when said rack engagement structure and said rack are moved into engagement with one another.

3. Self-adjusting pliers according to claim 2, wherein said second member comprises laminations disposed on opposite sides of said first member so as to connect said first member and said second member to one another.

4. Self-adjusting pliers according to claim 1, further comprising a spring member connected with said rack engagement structure, said spring member being constructed and arranged to normally maintain said rack engagement structure in a predetermined pivotal position during said initial manual movement of said first and second handle portions toward one another such that teeth of said rack engagement structure are disposed in generally parallel facing relationship with said teeth of said rack, said pivotal position being a desired pivotal position for said teeth of said rack engagement structure relative to said teeth of said rack during movement of said teeth of said rack engagement structure into engagement with said teeth of said rack, thus facilitating engagement of said teeth of said rack engagement structure with said teeth of said rack without requiring pivotal movement of said rack engagement structure.

5. Self-adjusting pliers according to claim 1, wherein said spring structure extending between said first and second members, said spring structure having opposing first and second ends, the first end of said spring structure being connected to the first handle portion of said first member and the second end of said spring structure being connected to the second handle portion of said second member;

one of said first and second members carrying a pivot in located rearwardly of said rack engagement structure, and the other of said first and second members having a slot that receives said pivot pin, said spring structure constructed and arranged to bias said first and second handle portions apart from one another so as to bias said pivot pin towards one end of said slot, the bias of said spring structure restricting relative movement between said first and second members during said initial movement to pivotal movement by maintaining said pivot pin at said one end of said slot during initial manual movement of said first and second handle portions towards one another so as to enable pivotal movement of said first and second members relative to one another about said pivot pin with said pivot pin remaining at said one end of said slot, said spring structure extending between said first and second members causes said pivot pin to move away from said one end of said slot and causes movement of said rack engagement structure toward said rack until said rack engagement structure engages said rack, thus changing the pivot point of said first and second members from said pivot pin to said rack engagement structure.

6. Self-adjusting pliers comprising:

a first member that comprises a first jaw that has a first workpiece engaging surface and a first handle member;

a second member that comprises a second jaw opposing said first jaw and a second handle member opposing said first handle member, said second jaw having a second workpiece engaging surface that faces generally towards said first workpiece engaging surface;

a spring structure that biases said handle members apart from one another;

said first and second jaws being operatively connected to said handle members such that manually moving said handle members towards one another against the bias of said spring structure moves said jaws towards one another in a closing direction to move said workpiece engaging surfaces towards one another for grasping a workpiece, said spring structure constructed and arranged to move said jaws apart from one another in an opening direction towards and into a fully opened position when said handle members are manually released;

said first member providing an engageable rack and said second member providing an rack engagement structure, said rack engagement structure and said engageable rack being constructed and arranged such that, when said rack engagement structure is engaged with said rack, movement of said handle members towards one another as aforesaid causes said handle members to pivot relative to one another about said rack engagement structure so as to continue moving said jaws toward another;

said rack engagement structure and said engageable rack being positioned with respect to one another such that, as said jaws are being moved in the closing direction thereof to grasp a workpiece, said second member moves relative to said first member so as to engage said rack engagement structure with said engageable rack in response to the workpiece engaging surfaces of said jaws contacting opposing sides of the workpiece; and a releasable lock carried by one of said first and second members, said lock being manually movable between (a) a releasably locked position wherein said releasable lock engages structure on the other of said first and second members to prevent relative movement between said handle members under the bias of said spring structure and hence relative movement between said jaws only when said handle members have been moved toward one another into a fully closed position, and (b) a released position wherein said lock is disengaged from the aforesaid structure on the other of said first and second members to thereby permit both relative movement between said handle members and relative movement between said jaws.

7. Self-adjusting pliers comprising:

a first member that comprises a first jaw having a first workpiece engaging surface and a first handle member;

a second member that comprises a second jaw opposing said first jaw and a second handle member opposing said first handle member, said second jaw having a second workpiece engaging surface that faces generally towards said first workpiece engaging surface;

a spring structure that biases said handle members apart from one another;

said first and second jaws being operatively connected to said handle members such that manually moving said handle members towards one another against the bias of said spring structure moves said jaws towards one another in a closing direction to move said workpiece engaging surfaces towards one another for grasping a workpiece, said spring structure constructed and arranged to move said jaws apart from one another in an opening direction towards and into a fully opened position when said handle members are manually released;

said first member providing an engageable rack and said second member providing an rack engagement structure, said rack engagement structure and said engageable rack being constructed and arranged such that, when said rack engagement structure is engaged with said rack, movement of said handle members towards one another as aforesaid causes said handle members to pivot relative to one another about said rack engagement structure so as to continue moving said jaws toward another;

said rack engagement structure and said engageable rack being positioned with respect to one another such that, as said jaws are being moved in the closing direction thereof to grasp a workpiece, said second member moves relative to said first member so as to engage said rack engagement structure with said engageable rack in response to the workpiece engaging surfaces of said jaws contacting opposing sides of the workpiece;

a movable member coupled to one of said first and second members; and a member-receiving structure provided by the other of said first and second members, said movable member being manually movable between (a) a releasably locked position wherein said movable member engages said member-receiving structure to prevent relative movement between said handle members under the bias of said spring structure and hence relative movement between said jaws, and (b) a released position wherein said movable member is disengaged from said member-receiving structure to thereby permit both relative movement between said handle members and relative movement between said jaws.

* * * * *